US005751011A

United States Patent [19]

McLaughlin et al.

[11] Patent Number: 5,751,011

[45] Date of Patent: May 12, 1998

[54] SYSTEM FOR PUNCHING HOLES IN A SPINNERETTE

[75] Inventors: Michael Ray McLaughlin; Timothy Martin Pinto; Ernest Edward Jessee, all of Kingsport, Tenn.; Leland Manfred Savage, Simi Valley; Vijay Somabhai Patel, Reseda, both of Calif.

[73] Assignee: Eastman Chemical Company, Kingsport, Tenn.

[21] Appl. No.: 492,551

[22] Filed: Jun. 20, 1995

[51] Int. Cl.[6] ..... G01N 21/86; G01C 3/08; H04N 7/18

[52] U.S. Cl. ..... 250/559.33; 250/559.29; 250/559.35; 348/95; 364/474.34

[58] Field of Search ..... 250/559.05, 559.29, 250/559.3, 559.33, 559.35, 559.38, 559.4, 559.42; 348/86, 94, 95, 135, 140, 142; 364/468.21, 474.01, 474.02, 474.08, 474.11, 474.21, 474.22, 474.24, 474.28, 474.34, 474.37

[56] References Cited

U.S. PATENT DOCUMENTS

| | | | |
|---|---|---|---|
| 4,485,453 | 11/1984 | Taylor | 364/474.28 |
| 4,743,771 | 5/1988 | Sacks et al. . | |
| 4,847,687 | 7/1989 | McDonnell et al. | 348/140 |
| 4,920,273 | 4/1990 | Sacks et al. . | |

*Primary Examiner*—Edward P. Westin
*Assistant Examiner*—John R. Lee
*Attorney, Agent, or Firm*—Charles R. Martin

[57] ABSTRACT

A system for accurately determining the relative location of countersinks formed in a predetermined pattern in a spinnerette blank, accurately positioning a punching tool, in turn, over each countersink and, in turn, punching accurately positioned holes in the spinnerette blank.

3 Claims, 6 Drawing Sheets

SYSTEM FOR PUNCHING HOLES IN A SPINNERETTE

BACKGROUND OF THE INVENTION

This invention relates to a system including apparatus for locating the position of countersinks on and punching holes into metal spinnerette blanks. The spinnerettes used in spinning synthetic fibers of cellulose acetate normally comprise a multiplicity of extremely small holes formed in a metal plate. Each hole is made by a multi-step process in which the first step (done in the conventional manner on a different machine) is to countersink a specified pattern of hole entranceways into a metal blank. This creates a "blister" under each countersink on the reverse side of the blank which is later ground off, leaving a thin metal foil, through which the actual hole is later punched with suitably shaped tools. Since a spinnerette may contain a large number of holes, each of which is less than 100 μm in its largest dimension, the accurate positioning of the punch over each of the countersink entrance ways is essential if the final hole is to be made without either damaging the sides of the entrance way or breaking the punching tool. Another problem arises from the fact that the countersink step deforms the metal of the spinnerette blank so that the final holes are not located exactly in the initial designed starting locations or positions.

The prior art for realigning the punch tool in reference to the countersink holes in the spinnerette blank required an operator to locate each hole manually by means of an optical microscope mounted above a spinnerette holding fixture. The positioning of the microscope is critical for the operator to obtain a well-lit image of each countersink. The microscope positioning is further complicated by the need for the positioning to be off the vertical axis in order to allow for positioning of the punch and its holder.

OBJECTS OF THE INVENTION

It is an object of this invention to provide a system for locating the position of countersinks on and subsequently finish punching the holes into metal spinnerette blanks. A further object of the invention is to provide a system for locating the position of countersinks in a spinnerette body and then finish punching holes at each countersink location in the spinnerette blank which requires a minimum of operator attention. It is a still further object of this invention to provide a system for (1) locating the position on the spinnerette where each hole is to be punched in both horizontal (X, Y) and vertical (Z) coordinates and also the orientation of other than round holes on the "theta" axis, which is rotation about the vertical axis; (2) locating the position of the punch with respect to that of the hole to be punched and orienting the punch about its theta axis so that the final hole, which may be non circular, has the desired orientation in the spinnerette; (3) with the information obtained in the locating procedure, moving the spinnerette laterally to position the hole entrance way beneath the punch; and finally, (4) moving the punch toward the spinnerette blank in the z direction the distance required to make the hole.

The present invention will be more fully understood by the reference to the following detailed description and the accompanying drawings:

SUMMARY OF THE INVENTION

Figure 1:
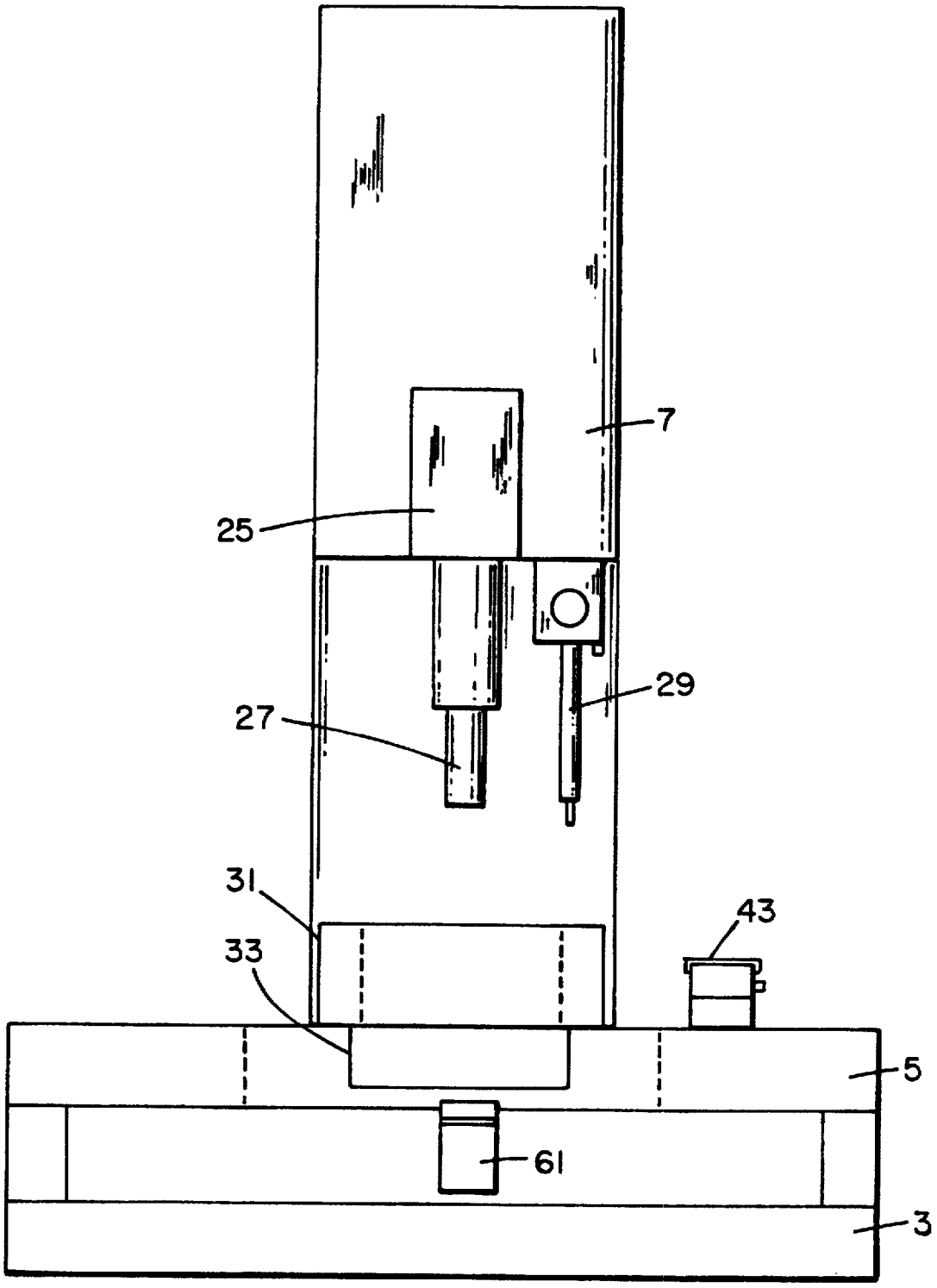
FIG. 1 is a diagrammatic view of the general configuration of the apparatus used in this invention.

This invention is a system for accurately determining the relative location of countersinks formed in a predetermined pattern in a spinnerette blank, accurately positioning a punching tool, in turn, over each countersink, and, in turn, punching accurately positioned holes in the spinnerette blank, comprising providing: a computer controlled optical coordinate measuring machine having staging movable in the X, Y, and Θ axes; a fixture mounted on said staging adapted to receive the spinnerette blank; a stage movable in the Z axis having a television camera and lens system mounted for movement with the stage; means to determine and to store the location of the Z stage; and means to return each stage to any previously stored location, the Z stage further having a punching tool mounted thereon for movement therewith, the punching tool being offset a predetermined distance from the television camera and lens system; mounting a spinnerette blank having a predetermined home row radius of countersinks in the fixture for movement in the X, Y, and Θ axes; moving the spinnerette blank via movement of the fixture to bring the innermost countersink hole, and, in turn, the outermost hole on home row radius under the lens system, determining the centroids of the countersinks and storing the locations in the computer; generating via the computer a two-point line passing through the centroids of the innermost and outermost countersinks located on home row radius; generating a local parts coordinate system; aligning the X-axis of the local parts coordinate system with its origin at the center of the countersink pattern with the two point line; in turn, locating each of the remaining countersinks, determining the location of their centroids and storing the locations in the computer, and in turn, moving the staging to position each countersink under the punching tool and lowering the punching tool a predetermined distance to punch the hole in the spinnerette.

Further, the optical coordinate measuring machine is provided with a foil covered offset stand mounted on the Y-stage for movement in the X and Y axes, further comprising generating a tool alignment reference line on the computer monitor screen and moving and rotating the reference line until it is aligned with a reference side of a non-round countersink image, moving the lens over the foil covered offset stand and storing the position of a point to be test punched, moving the stages to position the test stand under the punching tool, lowering the punching tool by means of lowering the Z-stage until the punch touches the foil and then moving the punch into the foil a depth sufficient to make an impression therein, moving the X and Y stages as necessary to center the lens over the impression in the foil, and adjusting the punching tool alignment so that an edge of the impression is parallel with the tool alignment line.

The optical coordinate measuring machine is further provided with a laser and detector mounted in a position below the exit side of a spinnerette blank mounted in said fixture to permit determining the exit side location on the Z-axis of the hole to be punched wherein, in turn, the exit side location of each countersink is positioned over the laser and the Z-axis location is determined, calculating the thickness of remaining metal to determine the thickness to be punched, moving the spinnerette blank in position under the punch and accordingly punching the hole.

DETAILED DESCRIPTION OF A PREFERRED EMBODIMENT

The apparatus of this invention includes features of a BAZIC 12 Operator Workstation Unit and a Data Gathering Unit, both manufactured and sold by View Engineering, Inc., 1650 North Voyager Avenue, Simi Valley, Calif., 93036, U.S.A. The units are further described in U.S. Pat. Nos. 4,743,771 and 4,920,273 and the description is incorporated herein by reference.

The Data Gathering Unit shown diagrammatically in FIG. 1 is the main physical component, providing an X-stage 3 that provides lateral movement on the X-axis, a Y-stage 5 that provides lateral movement on the Y-axis, and a Z-stage 7 that provides vertical movement on the Z-axis. All three stages employ a closed-loop DC-servo drive system that is closed through the feed back provided by use of a load mounted Heidenhain high-resolution linear glass scale. The X, Y, and Z stages have a maximum velocity of about eight (8) inches (203 mm) per second.

Figure 2:
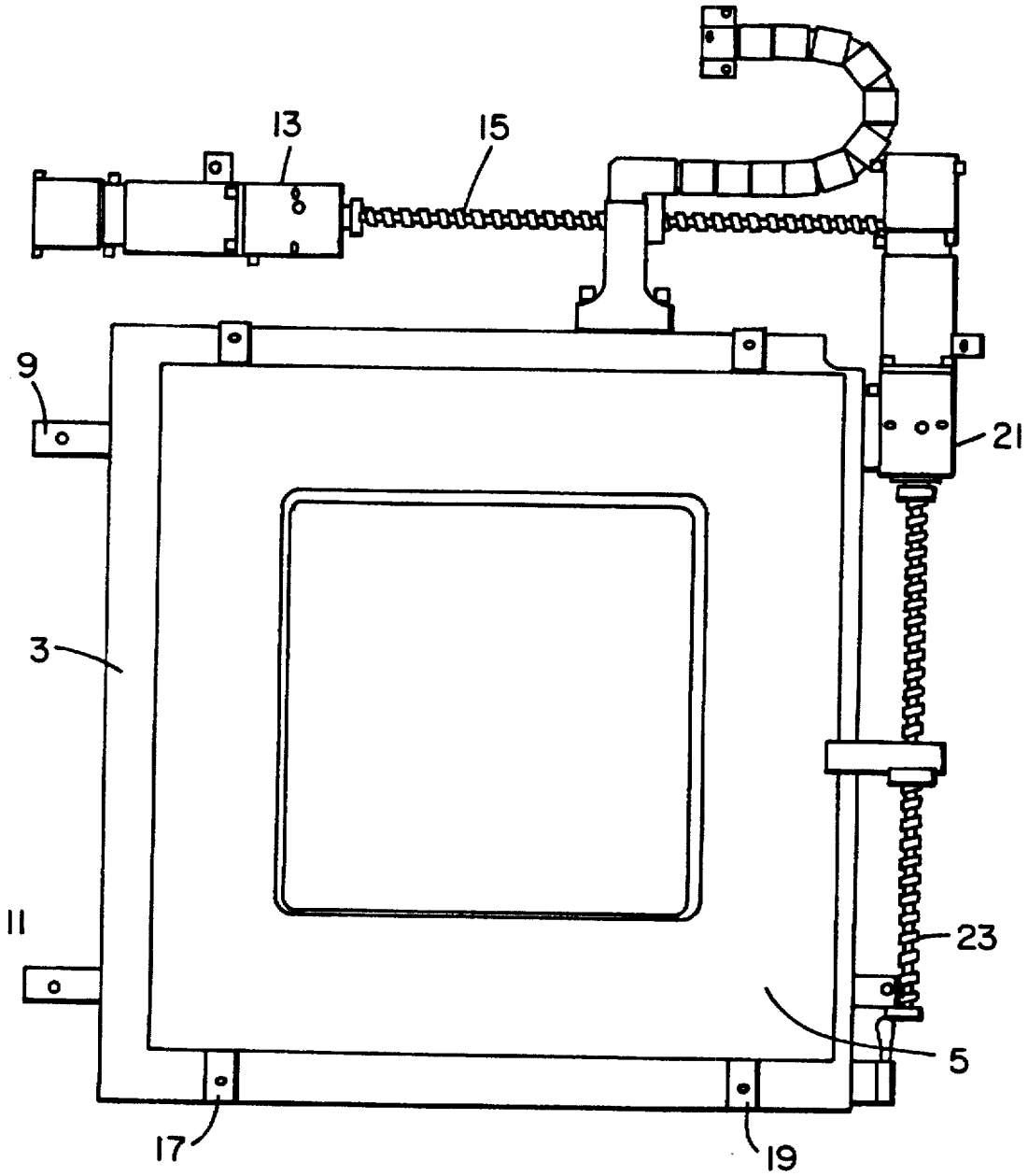
FIG. 2 is a diagrammatic view of X-stage and Y-stage showing mountings and servocontrols.

The X-stage 3 is mounted on guide rails 9 and 11 for movement in the X direction as shown in FIG. 2. A servomotor 13 turns a lead screw 15 which in turn pushes or pulls the stage along the guide rails 9 and 11. The Y-stage 5 is mounted on the X-stage for movement in the Y direction on guide rails 17 and 19. Movement is accomplished by a servomotor 21 turning a lead screw 23 which in turn pushes or pulls the stage along guide rails 17 and 19 in the Y direction. The Z-stage 7 as shown in FIG. 1 is mounted above the X and Y stages and is moveable on guide rails (not shown) in the Z direction. Mounted on the Z-stage is a TV camera 25 provided with a long working distance 20× lens. This lens provides for approximately ½" (12.7 mm) clearance of the fixturing. Combining the lens, the attached TV camera, and computer video display enlargement provides a magnification approaching 600×. This magnification is sufficient for the hole sizes of interest (20–100 μm).

The major components of each of the X, Y, and Z stages are the servomotor, lead screws, guide rails and linear glass scale. There is a photoelectric sensor of the encoder (not shown) that counts the increments of movement on the glass scale. The servocontrol circuitry translates the count data from the sensor into actual stage position information. That information is compared to commanded position and adjustments made accordingly. When the stage has reached the commanded position, the sensor continues to provide a number of counts signal which is used to verify that the stage is staying at the commanded position. This closed loop servocontrol system yields a stage that can move to a commanded position within 1 μm.

The lens 27 and camera assembly are mounted on the Z-stage for movement therewith. The punching tool holder 29 is likewise mounted on the Z stage at a known offset from the lens. This provides a means to move the holder and punch secured therein vertically with 1 μm accuracy. The optics are mounted in line with the lead screw moving the Z-stage to minimize any off axis movement.

Figure 4:
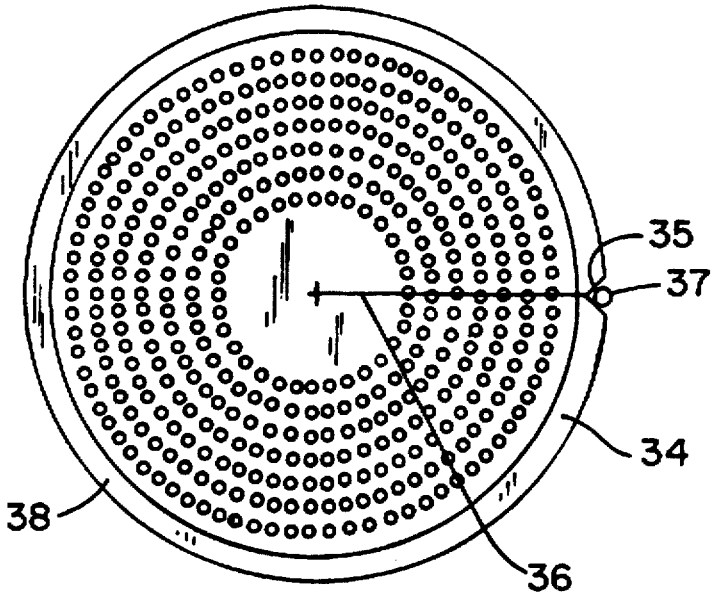
FIG. 4 is a spinnerette cup showing countersinks and having home row radius illustrated thereon.
Figure 3:
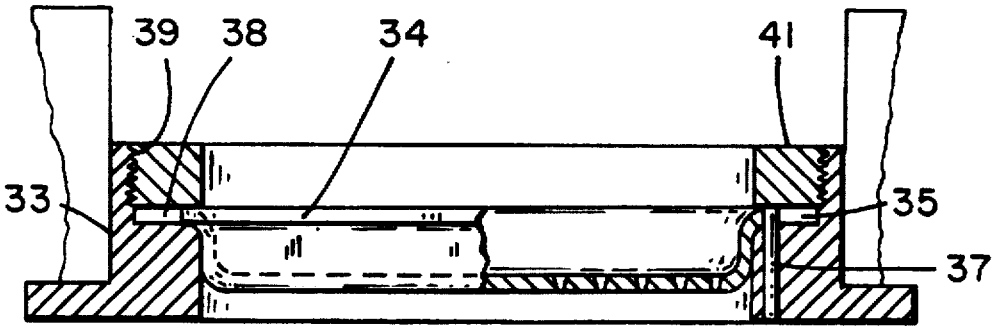
FIG. 3 is a cross-sectional view of the spinnerette cup holder having a spinnerette cup secured therein.

A high precision rotary stage 31 is mounted on and under the Y stage. The rotary stage 31 is provided with a fixture 33 specifically designed to hold a specified size spinnerette blank. The rotary stage 31 is a commercially available high precision angular positioning device. The rotary stage preferred is a Klinger RTN 160 MS right or left hand mounting and is sold commercially by Klinger, 999 Stewart Avenue, Garden City, N.Y., 11530. It is a worm gear driven device which features a double row of recirculating ball bearings resulting in high load carrying capacity and good rigidity characteristics. The rotary stage is mounted on the Y stage of the equipment by the use of tapped mounting holes on the base of the unit. The fixture 33 is mounted on the rotary stage unit for holding a spinnerette cup 34, shown in FIG. 4. The spinnerette cup or blank holder fixture shown in FIG. 3 is a high precision fixture specifically designed to hold the spinnerette cup on the rotary stage. The fixture surfaces are machined flat and parallel to each other. Parallelism is required so that when the fixture is mounted on the high precision rotary stage no excess wobble or run out are introduced.

The two-image analysis tools used in the process are the automatic focus tool and the centroid tool. The automatic focus tool is further delineated by being a surface focus method. The concept of an automatic surface focus makes use of the concept that best focus occurs when the object to be measured lies in the focal plane of the optical system. The height of the object relative to a reference can be determined by measuring the degree to which the image of the object to be measured is in focus in the image plane of the sensor such as in a television camera.

The degree of focus can be measured by the content of high frequency energy in the image, based on the fact that the sharpness of an image is generally proportional to the content of high frequency or wide band energy in the image. Thus, by moving the camera through the point of maximum high frequency spatial detail in the image, it is possible to establish the height of the surface by measuring the Z axis position of the camera at the point of best focus.

The camera and optical system are rigidly and solidly attached to each other so that the combination can be moved together as a unit in the Z axis direction with said Z axis motion being accurately and precisely controllable in either an up or down direction. Movement is achieved, as described earlier herein, by a servomotor mechanically coupled to a precision screw which raises or lowers the camera-optical system under precision electronic command and control.

In general an image is said to be focused when it contains a maximum of fine detail and when edges of objects contained within the image are sharpest. Resolution and definition are at their maximum values in a focused image. Another way of defining focus is to say that the highest spatial frequencies of the image are reproduced to the fullest extent. The automatic focusing system operates in a manner calculated to maximize the high frequency energy in an image.

Figure 5:
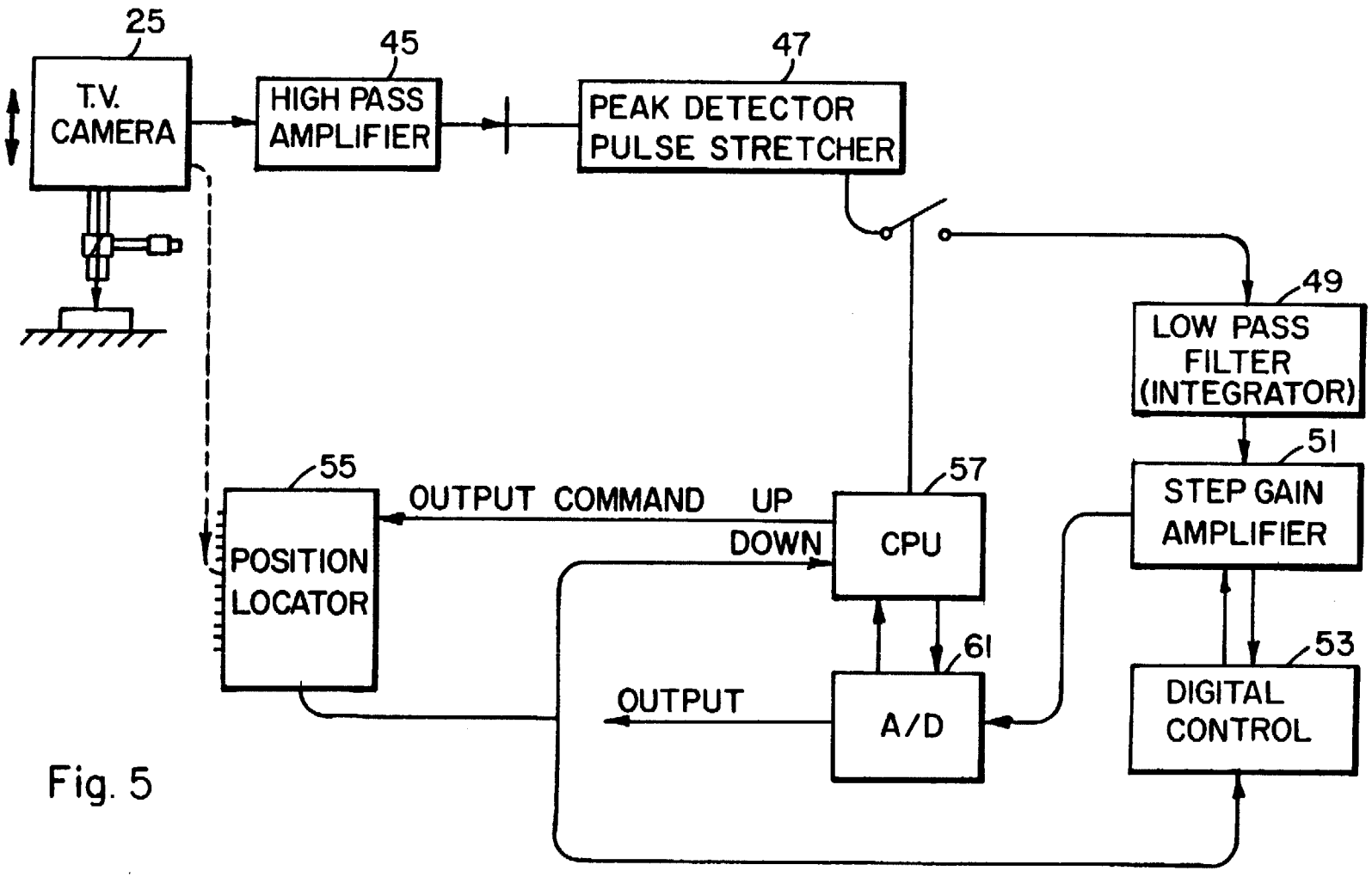
FIG. 5 is a block diagram of the overall system used to detect the maximum amplitude of an encoded signal as a function of best focus and hence the position of a surface.

The block diagram shown in FIG. 5 illustrates the overall system for detecting the maximum amplitude of the encoded signal as a function of the best focus and hence the position of the surface. During each scan of the sensor (the TV camera 25) the output is fed into a high pass amplifier 45 which amplifies mostly the higher frequency components removing any spurious dc signal drift. The output of the high pass amplifier 45 is fed to a peak detector pulse stretcher 47. The peak detector looks for a signal peak while the pulse stretcher enhances the time based reference of the signal. The integrator 49 integrates the energy content of the signal during a preferred time period. In other words, the output of the low pass filter integrator 49 would be a signal that would start at zero volts and ramp up to some positive voltage and in which the magnitude of the positive voltage would be representative of the degree of focus.

As the TV camera 25 moves in the Z or vertical direction and goes through focus, the amplitude of the detected signal on either side of focus is low and as the system approaches focus, the amplitude rises and reaches a peak and as the TV camera 25 passes through focus the output of the amplitude decreases.

At discrete positions determined by the speed of the mechanical motion in the Z axis of the TV camera 25 and the data processing and sampling rates of the electronics in the computer, the system continually makes a measurement of the amplitude of the detected signal. This process takes the analog signal from the low pass filter integrator 49 and passes it through a step gain amplifier 51 that is controlled by a digital control system 53. The signal is then converted to an eight bit digital number. The eight bit digital number is then read by the computer and stored. A position locator 55 contains a highly accurate scale, in this case a Heidenhain glass scale manufactured by Heidenhain Corporation for accurately determining the position of the TV camera. A central processing unit 57 cooperates with the position locator 59 and feeds an analog to digital (A/D) converter 61 which also receives an output of the step gain amplifier 51 for generating the desired output signals for each position of the TV camera 25.

At each point of movement of the TV camera, a measurement of the amplitude of the focus value which is the output of the low pass filter integrator 49 is determined in order to determine the Z axis position. A complete range of values in the Z axis is determined on either side of focus. The central processing unit 57 processes these values to determine the theoretical maximum value and correlates this maximum with the actual position of the TV camera 25 from the position locator 55 to generate an output signal from the A/D converter 61 indicative of best focus which is also indicative of the surface under test.

Height measurement differences are determined at different points and the focus value at two different points is read by the computer and subtracted and the output signal is the height differential between those two points.

Figure 6:
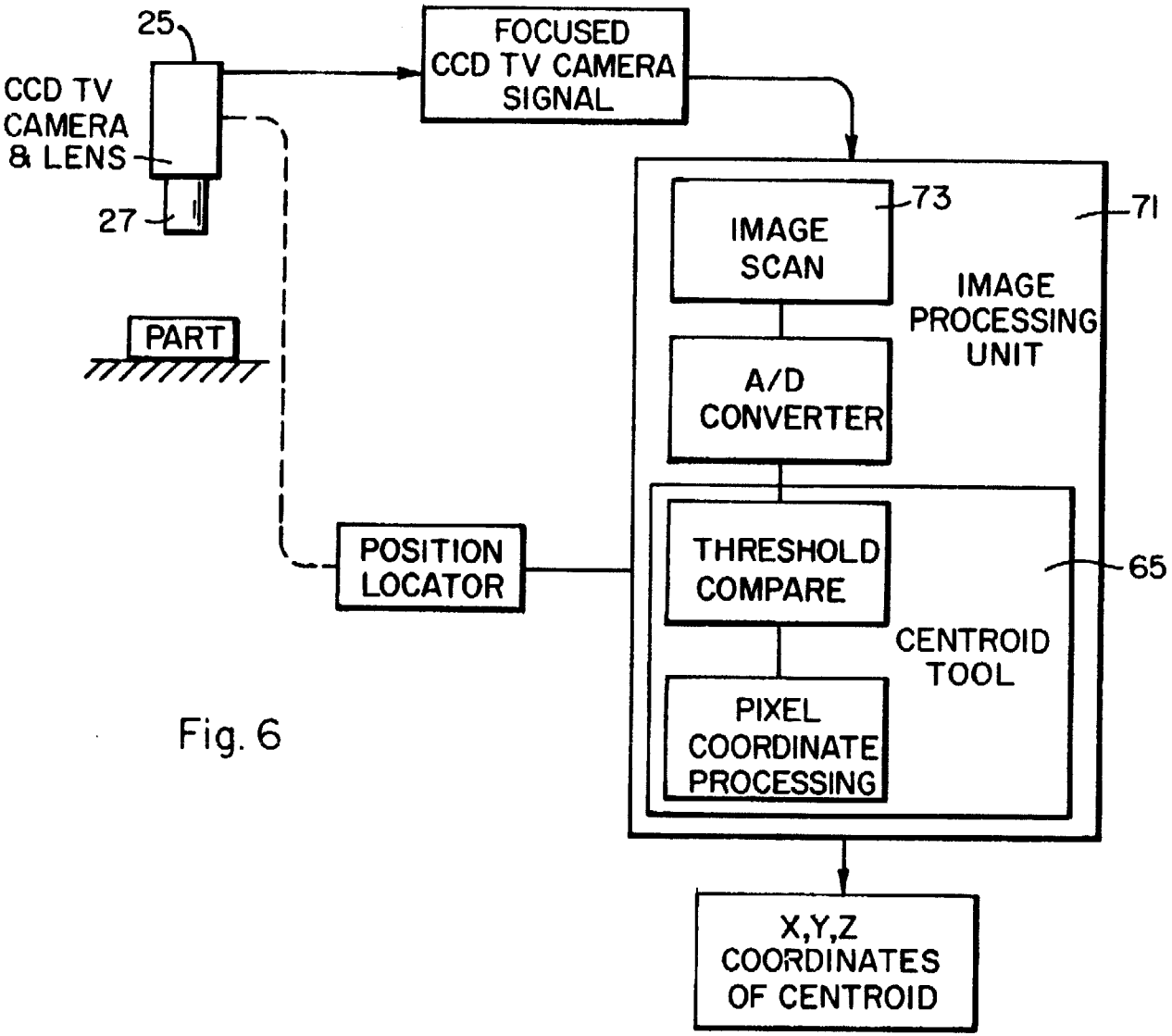
FIG. 6 is a block diagram of the overall system used to calculate the centroid of a feature lying entirely within the camera field of view.

The Data Gathering Unit provides a centroid tool 65, illustrated in FIG. 6, which is used to calculate the centroid (center-of-mass point) of a feature that lies entirely within the camera field of view. For example the centroid tool can locate the centroid of a feature, and locate it in X and Y coordinates. The Z coordinate of the point is established previously, by automatically focusing the feature before applying the centroid tool.

The field of view is imaged by the optic train consisting of the long working distance 20× lens 27 coupled to the television camera 25. The working sensor of the camera is a grid of pixels (picture elements) 512 wide (X axis) by 480 high (Y axis). For this application it is preferred that each pixel is 0.648 μm/pixel, although other magnifications of that magnitude would provide the resolution needed. Each pixel generates an analog voltage which is converted by an 8 bit resolution A/D converter to a digital signal with a value from 0 (black) to 256 (white). The range between 0 to 256 is referred to as gray level.

The centroid tool defines a feature by seeing the pixels that comprise the desired feature as ON, and those belonging to the background or to extraneous features as OFF. To do this the tool, via the image processing unit (IPU) 71, looks at the pixels within its area, scanning pixel by pixel along the sensor X axis, and line by line vertically along the sensor Y axis via image scan 73. As the IPU scans, it compares the pixel gray level values to two threshold values. Pixels whose gray level values lie at or between the thresholds are defined as ON; those outside it are OFF. As the processor scans the pixels, the system also keeps a running total of the number of ON pixels. For example, if the thresholds have been set at 72 and 170, pixels whose intensities lie below 72 or above 170 are OFF.

The centroid tool can return the following information about the feature to the system: The coordinates of the centroid and the number of ON pixels. To calculate the X coordinate of the centroid (center of mass point), the system sums the X coordinate values of all the ON pixels and divides it by the total number of ON pixels. Similarly to calculate the Y coordinate, the IPU sums the Y coordinate values of the ON pixels and divides it by the total number of ON pixels.

The X and Y coordinates are relative to the field of view coordinates. The field of view measurements are then referenced back to the part coordinate system described later herein via the stage location of the part during measurement. The part coordinate system is finally referenced back to absolute machine coordinates via the precision glass scales which provide feedback measurement of the stages position.

The system can also use the number of ON pixels to calculate the area of the feature. To calculate the feature's area the system multiplies the number of ON pixels by the area of a single pixel.

Now that the image analysis tools have been detailed, it is necessary to explain the importance of coordinate systems and part alignment in those systems. The system finds points on a part by making movements in X, Y, and Z directions from an established origin within the established coordinated system. Whenever the system is powered on, the origin is established in the machine coordinates system (MCS). The MCS origin is a hardware origin located at the left, back, upper most position of the X, Y, and Z stages. For the added rotary system its origin is at 0°. In the MCS moves to the right are positive X; forward moves are negative Y; and downward moves are negative Z.

All image processing tools are referenced to the size, location, and coordinate system when they are initially defined. For example a centroid tool 100 μm X by 100 μm Y centered at 229, −152, −76 mm (MCS) is used to locate a feature on a part. If that centroid tool is used again it will look at the same MCS coordinates (229, −152, −76 mm) for a feature. If the fixturing to hold the examined part has moved, or the feature of interest is outside the 100×100 μm window the centroid tool would not be able to correctly return a value.

The alternative to accurate placement of the part is to establish an inspection origin within a coordinate system, known as the part coordinate system (PCS), on the part itself before any further measurement tools are used. Once the PCS origin is established (via an assignment statement) all subsequent measurement tools are located relative to the PCS origin.

The PCS approach is the preferred mode for spinnerette manufacturing. It has been found that at the magnifications used the features of interest are rarely where they are expected. A PCS origin can, with some initial setup effort, be located at the center of the hole pattern with the X axis parallel to the home row radius (defined later herein). Once this PCS is defined for the hole pattern all moves are made in the known units of millimeters of movement along the X axis and degree movements along the rings of the hole pattern. The users do not need to concern themselves with where a countersink is in the MCS, just the PCS. All the aspects of coordinate system transformations are now performed automatically without operator intervention via the system operating software.

The countersinks are made on a fixture moved by an X stage (for ring-to-ring moves) and a theta stage for angular moves on a ring. This setup creates a single radius where every other hole along that radius is on the radius. Every other ring of holes is slightly offset to allow for maximum hole density placement. For the sake of communication, the single radius 36, shown in FIG. 4, where every other hole is on the X axis is called "home row radius".

High precision fixturing (flatness of surface, parallel surface, low run out of opposing surfaces) enhances part realignment. The fixture shown in FIG. 3 incorporates a locating pin 37 to facilitate spinnerette blank or cup orientation. The pin mates with a notch 35 formed in the spinnerette blank 34 and is generally aligned with home row radius 36. Use of pins for alignment allows the operator to know where to start looking for the two specific holes to be used in realigning the spinnerette blank. The fixture 33 is a collar having a spinnerette blank receiving seat formed therein, as shown in FIG. 3, the seat having inner surfaces which mate with the lower outer surfaces of the flange 38 of the spinnerette blank when the blank is mounted in the fixture 33. The upper inner surface of the fixture is threaded 39 to receive a threaded ring 41 so that the spinnerette blank can be securely locked into the fixture.

The initial countersinking and the subsequent removal of the blisters require removing the blank containing the countersinks from a countersink machine fixture. As soon as the spinnerette is moved, the datum of the center of the pattern is lost. The countersink step of spinnerette manufacture imparts a good deal of energy to the metal blank. So much metal is moved around during the countersink step that every subsequent countersink affects the previous countersink's location. Machine tolerances are also required to allow for moving the spinnerette from process to process. Since the countersink positions are only approximately known, a realigning of the spinnerette to the machine's fixturing is required. With the combined tolerances of the fixtures, the spinnerette blank cup, and the tooling to make the actual hole, it is impossible to depend upon fixturing to relocate the center of the pattern.

There are two conditions where the center of the pattern is superfluous information: 1) When the holes are translated (instead of rotated) and 2) for round holes. For a round hole spinnerette, the center of the pattern is not needed since the spinnerette could be translated to generate the same pattern as a rotated spinnerette. If needed, a round hole spinnerette could be made on the equipment by locating the Z position of the tool, and the X, Y, and Z positions (no theta) of the countersinks. Spinnerette hole countersinks, both round and non-round, are made on a separate machine using the motion of an X stage and rotary stage. Since it is required to reproduce the pattern created on the upstream countersink machine, it is critical to be able to relocate the imaginary center of a countersink layout pattern for non-round countersinks. By determining this center, the pattern can be computer controlled to rotate about that center and reproduce the operation of the countersink machine. This procedure allows the subsequent punching tool to reenter the countersink and punch the hole.

Since home row is a radius, the start of home row radius is the center of the pattern. Every ring of holes in a spinnerette has a design diameter. To compute the imaginary center of the pattern, all that is needed is to locate the home row radius. To maximize the accuracy of the home row determination, the innermost and outermost countersink images along home row radius are used. The centroids of the two countersink images define the two points used to determine a line. Each countersink is located on a ring of known diameter, and to further compensate for metal movement the center point is averaged from the center location of each ring as measured.

$$\text{Center}_{average}=(\text{center}_{point\ 1}+\text{center}_{point\ 2})/2$$

where $$\text{center}_{point\ 1}=\text{centroid position}_{point\ 1}-\text{design diameter}_1/2$$

and $$\text{center}_{point\ 2}=\text{centroid position}_{point\ 2}-\text{design diameter}_2/2.$$

The above equations simplify the fact that the centroids of the countersinks are determined with X, Y, and Z axes data.

After the local PCS is defined at the center of the pattern along home row, all moves are made in the same units used to define the pattern. Ring to ring moves are made in millimeters. Countersink to countersink moves are made in degrees (360/number of countersinks in that ring).

The Z axis origin is also set to the center point during this alignment process. The theta axis is not affected by the alignment since the local PCS has its datum at 0 degrees. This datum is set to agree with previous manufacturing steps.

Now that the spinnerette has been realigned to the coordinate systems and countersinks can be found, the next step is to determine where the punch tooling is relative to the optic train. The tooling offset from the optic train includes X, Y, and Z data. In addition to these data the actual orientation of the tool about its Θ axis must be determined.

The punching tool is held in a high precision pin vice mounted in a custom-made, preloaded 48 pitch worm gear drive assembly. Preload is provided to minimize backlash. The load is created by a set screw pushing against a ball bearing and the shaft of the holder which is attached to a spring washer. The gearing provides 7.5 degrees of tool rotation per 1 rotation of an indexing knob which is attached to the worm gear. This gear ratio provides the fractional degree control for properly aligning the tool's cross-section to the countersink configuration. For example, when making a triangular cross section, the corners of the punching tool must be aligned to reenter the tips of the countersink triangular cross section.

To facilitate this alignment requirement, a foil holding stand 43, shown in FIG. 1, is mounted in any convenient manner on the Y-staging in any suitable location that allows for it to be accessed by both the optics and punching tool. The height of the stand is such that it is above the top of the fixture mounted on the underside of rotary stage 31, to minimize the chance of damaging the optics while making an impression on the foil with the punching tool. A slight impression is made with the punching tool in the foil while the lens still clears the stage.

The foil and the punching tool are electrically isolated from each other. A continuity circuit is made between a motion control computer parallel port and electrical ground. Electrically, leads from both the punching tool holder and the foil holder are attached to the parallel port of the computer. Five volts are provided by the computer power supply to the circuit. The tool is not touching the foil pad when the computer senses five volts (relative to ground) on the circuit (open circuit). The tool is touching when there is zero volts across the circuit (closed circuit). Since the continuity circuit is checked via software on the motion controlling computer, the circuit can be checked every 10 μm of Z axis travel as the punching tool moves toward the foil. The foil/punching tool continuity circuit allows locating the Z position of the tip of the tool within 10 microns, repeatable to within 2 microns (determined experimentally). The X, Y, and Z coordinates of the tip of the punching tool are determined by viewing the impression of the punching tool in the foil.

To align the punching tool (via its rotational adjuster), a reference is needed, based on the orientation of an actual countersink. This separate reference is needed since the optics cannot get images of both the countersink and the foil holding stand in the same field of view.

Figure 7:
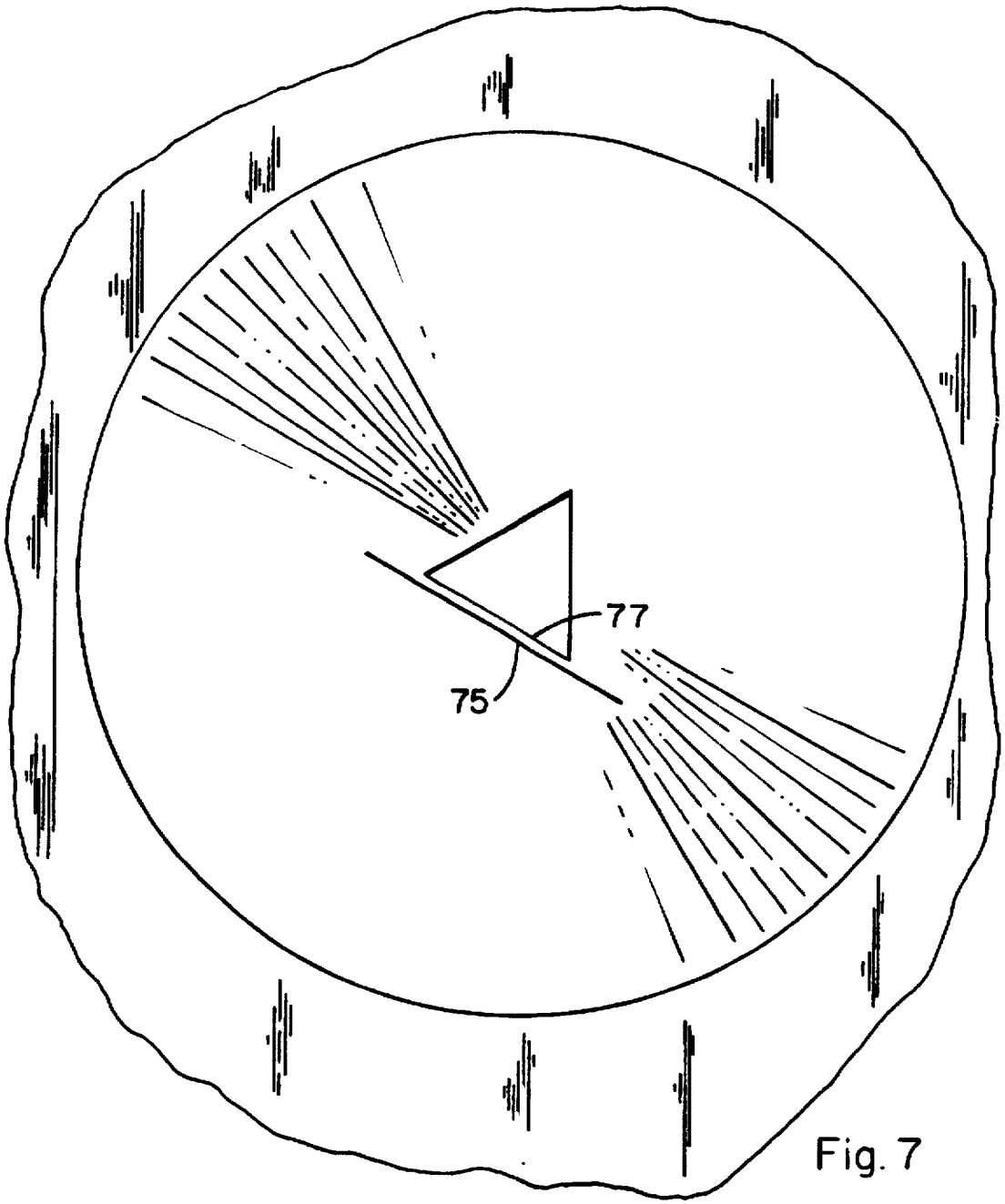
FIG. 7 is an illustration showing an orientation line aligned parallel with one side of a non-round punch impression.

By placing a tool alignment line parallel to an edge of the prepunch image 77, as shown in FIG. 7, one has a reference when aligning the punching tool. The alignment line stays on the computer monitor screen while the punch location is determined. For punch orientation, a punch impression is made in the foil and the operator checks an edge of the impression to insure it is parallel with the orientation line as shown in FIG. 7. If it is not, adjustments of the punching tool can be made. Once the punching tool orientation is achieved, the tool orientation line is removed from the computer monitor.

It is to be understood (though not shown) that in addition to the punching tool mounted on the Z-stage for movement therewith, additional tools, such as hole formation tools may be mounted on the Z-stage for operation in the same manner described for the punching tool. In the system of this invention the additional tools are positioned using the same programs used to position the punch when punching the holes in the spinnerette cup. The difference is that the offsets of the additional tools are in locations offset from the punch tool holder and the TV camera optical system.

It is necessary to determine the thickness of metal remaining between the bottom of a countersink and the exit surface of the spinnerette cup after the blister has been ground off. This can be done manually by using a conventional measuring probe apparatus and measuring several countersinks metal thicknesses and using this information to set the punching apparatus to move the punch a predetermined distance for each punch.

A preferred method is to provide means to measure the metal thickness remaining in each countersink bottom and exit surface of the spinnerette blank. This invention provides for a non-contact measurement of the remaining metal thickness of each countersink. To accomplish the non-contact measurement a LED laser and detector 61 are mounted on the optical coordinate measuring machine in a position below the lower or exit side of a spinnerette mounted in the fixture as indicated in FIG. 1. Staging and fixturing are spaced to the extent necessary to allow the correct working distances for the TV camera based image collection and the laser and detector.

The use of the laser and detector adds the capability to determine the inlet and exit datum for each hole to be punched in the spinnerette blank. In this regard the "Z" datum from top lit TV image is determined, as described earlier herein, by locating the image of the interior of the countersink. The precise location of the countersink in the "X", "Y", and "theta" axes is determined and stored. The datum from the laser detector is determined. The laser optics are positioned a known "X", "Y", and "Z" offset distance from the TV camera based optics. After the inlet side of all the countersinks are measured, the countersinks are then repositioned above the laser based optics. The laser system controls are then polled to capture the position of the exit side of the given countersink. After determining these two locations along the Z axis (inlet and outlet) the depth to punch can be accurately and precisely calculated. The calculation takes into consideration the geometry of the punch and the desired final hole size and capillary length.

The laser, as mentioned earlier, is mounted on the optical coordinate measuring machine. The sensor is mounted in a custom square tube. The tube is mounted at both ends such that it straddles the X stage. This configuration allows both stages to still travel their full strokes. Internal to the square tube are both the laser/detector package along with the conventional fiber optic back light. The back light is mounted collinear to the optic train. The laser sensor is mounted forward of the back light as the operator faces the machine. The laser mount also provides an adjustable screw based elevator to allow for gross focusing of the laser about the center of its focus range. This positioning is along the Z axis of the laser sensor package.

The laser stylus' electronics provides three measurement signals: (1) a digital LED readout; (2) an analog LED readout; and (3) an analog signal of +/−10 v. The LED displays (digital and analog) provide the operator visual feedback that the system is working. In this application the analog signal is fed to an A/D converter. The scale factor for the stylus is set (once at the factory) via the SUI. Scaling the signal allows direct reading of 300 μm at 10 v and −300 μm at −10 v. To obtain a measurement the standard probe commands are issued and the measurement is made directly in microns.

One laser useful in this invention is the Rodenstock LASER Stylus RM600 which consists of a sensor and a sensor interface. The optical non-contact method has a 2 μm spot size for the laser sensor. The laser beam is focused on the surface and the spot is reflected back to a focus detector. As the distance to the object is changed (i.e., moving from hole to hole), the focus detector creates a focus error signal, which is used for measurement. The actual error signal is generated via an autofocus routine. The auto focus is achieved as a servo system adjusts the objective until the beam is focused on the surface. The optic position is registered and used as a measuring signal. The control unit for the sensor is interfaced to the optical coordinate machine computer and the data collected.

It is necessary to determine the laser optics X and Y offsets from the optical coordinate machine optics. This procedure is done only on initial setup of the equipment or when any mechanical adjustments are made to the fixturing. To perform this procedure, a special spinnerette blank is mounted in the rotary stage fixturing. The blank has a large (by spinnerette hole standards) hole drilled in the approximate center. The hole is approximately 0.03" (0.76 mm) in diameter. This hole is located manually with the optics and the SUI. The hole is back lit (from the underneath—same side as laser) and is relatively easy to find. After the hole is found, a three-point circle tool (a standard View image analysis tool) is used to determine the center of the hole and those coordinates are stored.

The laser is then used to find the same hole. The laser system is capable of focusing on anything +/−0.3 mm from its focal point center. The hole is moved over the laser optics. The control panel for the laser has a series of LEDs which indicate in focus/out of focus. As the hole passes over the laser, the laser cannot focus (it is a hole) and the LEDs indicate out of focus. By noting the in/out of focus of the area around the hole the center of the hole can be closely approximated.

The X, Y coordinates of the center of the hole from the optical coordinate machine optics and laser optics have now been determined. The X, Y offsets of the laser are determined by subtracting its coordinates of the hole center using stage coordinates from that of the optical coordinate machine coordinates:

$$\text{laser offsets}_{x,y}=\text{X,Y hole center}_{RM600}-\text{X,Y hole center}_{\text{optical coordinate machine}}$$

Since the need for having the laser is that the surface of the cup is non-flat, there is no way to determine a permanent offset for the Z axis. What is done, instead, is to create a datum for every spinnerette. The subsequent hole measurements are made relative to that datum. The datum for the process is to measure the remaining metal thickness of the first hole with a mechanical probe. The laser system then measures every hole and the optical coordinate machine computer records the measurements relative to thickness of the first hole. The advantage is that the measurements are made without damaging the holes since it is a non-contact measurement.

Cycle of Operation

The following is a cycle of operation to illustrate the system of this invention.

Begin with a spinnerette cup blank that has all the holes already started through the first countersink step with the exit blisters or protuberances ground off. The spinnerette blank or cup has an aligning notch 35 or detent in the cup flange which is at the "home row radius" of countersinks previously made in the cup. The cup is placed in the fixture 33 under the rotary stage with the notch 35 in alignment with aligning pin 37 provided on the fixture. The threaded ring 41 is then tightened to securely lock the spinnerette cup or blank in the fixture.

Now using the View simplified user interface (SUI) (which permits moving along the various features of the machine operator interface) the coaxial lens light is set to obtain a good countersink image.

Using the SUI via the joystick, move the staging under the lens of the camera mounted on the Z-stage to bring the first non-offset hole along home row radius into view through the lens. Center the hole in the field of view. Store this position with the SUI.

Next the preprogrammed user interface, to determine tool offsets, is run via the SUI. This program draws a colored reference line on the screen. Using the arrow, –, and = keys move and rotate the line until it is parallel with one side of the cross-section (this is not necessary for a round cross-section). Use the SUI and joystick to move the lens over the foil covered offset stand. When the foil image is focused, position the crosshair where you want to test punch. The program then moves the stages (with the stand) over to and underneath the punch tool by a predetermined offset. The offset is determined initially and from that point is always recalled from the last offset determined via this program. The program then lowers the tool 10 μm and checks to see if it has touched the foil (via a continuity circuit). This is repeated until the tool touches the foil. The tool is then moved down into the foil deep enough to make a good impression approximately 10–30 μm. The program then moves the staging so the impression is located under the lens and is in the field of view. The operator then moves the stages to center the lens, as indicated by the crosshair over the impression, fine-tuning the offsets. The punch tool holder is rotated via a worm gear knob to adjust the alignment of the punch tool cross section parallel to the colored line. This process is repeated until the offsets and angular rotation are acceptable.

The next preprogrammed interface, to determine countersink locations, is run via the SUI. The program requests the pattern information: hole size; number of rings; the ring-to-ring distance; number of holes per ring; and the depth punching datum for the spinnerette. The program then requests the operator to indicate the innermost zero offset hole along home row radius. Use the SUI to move back to the stored location determined earlier. Approximately center the crosshair over the hole with the joystick. Several field of view tools are automatically used to fine tune and store the centroid of this countersink. Next, the interface requests to be shown the outermost non-offset hole along home row radius. Using the SUI and joystick, indicate that approximate center of the hole by centering the crosshair over the countersink image.

These two points (centroid of the cross-section) are then used to define a line which is internally set parallel to the X axis stage coordinate system. This becomes the local coordinate system of the spinnerette. The program then automatically moves the staging to locate all the remaining holes and determine their centroids (X, Y, Z, and theta coordinates). The laser is used as described to determine the Z coordinate of the exit side of each countersink in the spinnerette blank or cup. The thickness of the remaining metal is calculated by subtracting the inlet side dimension from the exit side dimension. These data are stored as to where to punch and how deep to punch.

After all the data is collected, the SUI is then used to run the punching program. The punching program moves the staging and repositions every hole under the punch tool, lowers the tool the predetermined amount, and punches the hole.

The invention has been described in detail with particular reference to certain preferred embodiments thereof, but it will be understood that variations and modifications can be effected within the spirit and scope of the invention.

We claim:

1. A system for accurately and precisely determining the relative location of countersinks formed in a predetermined pattern in a spinnerette blank having an exit side, accurately positioning hole punching and forming tools, in turn, over each countersink, and, in turn, punching and forming accurately positioned holes in the spinnerette blank, said system comprising:

a computer controlled optical coordinate measuring machine having staging, comprising an x-stage, y-stage, and Θ stage, movable in the X, Y, and Θ axes, respectively;

a fixture mounted on said Y-staging adapted to receive the spinnerette blank and mounting the spinnerette blank having a predetermined home row radius of countersinks in the fixture for movement in the X, Y, and Θ axes, the home row radius of countersinks having the innermost countersink hole nearest the center of the predetermined pattern of countersink holes and its outermost hole at the opposite end of the home row radius of countersink holes;

a stage movable in the Z axis having a television camera and lens system mounted for movement with the stage and having tools mounted thereon for movement therewith, the tools being offset a predetermined distance from the television camera and lens system;

means to determine the location of and to store the location of the Z stage; and means to return each stage to any previously stored location.; and said machine moving the spinnerette blank via movement of the fixture to bring the innermost countersink hole, and, in turn, the outermost hole on home row radius under the lens system, determining the centroids of the countersinks and storing the locations in the computer, generating via the computer of said machine a two-point line passing through the centroids of the innermost and outermost countersinks located on home row radius, generating a local part coordinate system, aligning the X-axis of the local part coordinate system with its origin at the center of the countersink pattern with the two point line, locating, in turn, each of the remaining countersinks, determining the location of their centroids and storing the locations in the computer, moving, in turn, the staging to position each countersink under the tool and lowering the tool a predetermined distance to punch the hole in the spinnerette.

2. The system of claim 1, further comprising a foil covered offset stand mounted on the staging for movement in the X and Y axes, and said machine generating a tool alignment reference line on the computer monitor screen and moving and rotating the reference line until it is aligned with a reference side of a non-round countersink image, moving the lens over the foil covered offset stand and storing the position of a point to be test punched, moving the stages to position the test stand under the punching tool, lowering the punching tool by means of lowering the Z-stage until the punch touches the foil and then moving the punch into the foil a depth sufficient to make an impression therein, moving the X and Y stages as necessary to center the lens over the impression in the foil, and adjusting the punching tool alignment so that an edge of the impression is parallel with the tool alignment line.

3. The system of claim 1 or 2, further comprising a laser and detector mounted in a position below the exit side of a spinnerette blank mounted in said fixture to permit determining the exit side location on the Z-axis of the hole to be punched wherein said machine, in turn, positions the exit side location of each countersink over the laser, determines the Z-axis location of each countersink, calculates the thickness of remaining metal to determine the depth to be punched, moves the spinnerette blank in position under the punch, and accordingly punches the hole.

* * * * *